US007222936B2

(12) United States Patent
Griesemer et al.

(10) Patent No.: US 7,222,936 B2
(45) Date of Patent: May 29, 2007

(54) PRINTHEAD CARRIER POSITIONING APPARATUS AND METHOD

(75) Inventors: Frederick Charles Griesemer, Lexington, KY (US); Martin Alan Johnson, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 266 days.

(21) Appl. No.: 10/843,610

(22) Filed: May 11, 2004

(65) Prior Publication Data

US 2005/0253893 A1 Nov. 17, 2005

(51) Int. Cl.
*B41J 23/00* (2006.01)
*B41J 29/38* (2006.01)

(52) U.S. Cl. ..... 347/37; 347/14

(58) Field of Classification Search ..... 347/37, 347/14, 19

See application file for complete search history.

(56) References Cited

U.S. PATENT DOCUMENTS 5,627,570 A 5/1997 Hiramatsu et al.
5,742,302 A * 4/1998 Kohri et al. ..... 347/23
6,015,204 A 1/2000 Ha
6,065,831 A 5/2000 Kawaura et al.
6,170,946 B1 1/2001 Yasui et al.
6,247,784 B1 * 6/2001 Obana et al. ..... 347/37
6,250,735 B1 6/2001 Kaneko et al.
6,382,858 B1 5/2002 Nojima et al.
6,530,634 B1 * 3/2003 Hara ..... 347/7
6,550,910 B2 4/2003 Hwang
7,088,475 B1 * 8/2006 Terashima et al. ..... 358/448
2003/0055732 A1 * 3/2003 Nagata ..... 705/22
2003/0063177 A1 * 4/2003 Yoshimura et al. ..... 347/108
2003/0137578 A1 7/2003 Yamazaki
2003/0218651 A1 * 11/2003 Fukano et al. ..... 347/19

* cited by examiner

*Primary Examiner*—Stephen Meier
*Assistant Examiner*—Rene Garcia, Jr.
(74) *Attorney, Agent, or Firm*—Taylor & Aust, P.C.

(57) ABSTRACT

An imaging apparatus includes a housing having a cartridge exchange opening, and a printhead carrier system contained in the housing. The printhead carrier system has a printhead carrier. A cover is pivotably attached to the housing. The cover has an engagement surface. When the cover is in a closed position the cartridge exchange opening is not exposed. A switch unit has a switch actuator and a switch. The engagement surface of the cover is positioned to engage the switch actuator when the cover is in the closed position. The switch actuator is configured with a button that is accessible by a user to facilitate manual manipulation of the switch actuator by a force applied to the button by the user. The printhead carrier is positioned based on an output of the switch.

12 Claims, 5 Drawing Sheets

PRINTHEAD CARRIER POSITIONING APPARATUS AND METHOD

BACKGROUND OF THE INVENTION

1. Field of the Invention

The present invention relates to an imaging apparatus, and, more particularly, to a printhead carrier positioning apparatus and method.

2. Description of the Related Art

A typical ink jet printer forms an image on a print medium by ejecting ink from a plurality of ink jetting nozzles of an ink jet printhead to form a pattern of ink dots on the print medium. The ink jet printhead may be formed integral with a cartridge containing a supply of ink, thus forming a printhead cartridge. Such an ink jet printer typically includes a reciprocating printhead carrier that transports one or more printhead cartridges, that mount the ink jet printheads, across the print medium along a bi-directional scanning path defining a print zone of the printer. A sheet feeding mechanism is used to incrementally advance the print medium sheet in a sheet feed direction, also commonly referred to as a sub-scan direction or vertical direction, through the print zone between scans in the main scan direction.

When the ink supply contained in one of the printhead cartridges is depleted, then typically the printhead cartridge is replaced. In order to simplify printhead cartridge replacement, some printers include an opening that provides a user with sufficient space to change-out the printhead cartridge.

What is needed in the art is a printhead carrier positioning apparatus and method to aid in the positioning of the printhead carrier at a cartridge exchange opening for convenient printhead cartridge replacement.

SUMMARY OF THE INVENTION

The present invention provides a printhead carrier positioning apparatus and method to aid in the positioning of the printhead carrier at a cartridge exchange opening for convenient printhead cartridge replacement.

The invention, in one form thereof, relates to an imaging apparatus. The imaging apparatus includes a housing having a cartridge exchange opening, and a printhead carrier system contained in the housing. The printhead carrier system has a printhead carrier. A cover is pivotably attached to the housing. The cover has an engagement surface. When the cover is in a closed position the cartridge exchange opening is not exposed. A switch unit has a switch actuator and a switch. The switch actuator is configured for actuating the switch. The engagement surface of the cover is positioned to engage the switch actuator when the cover is in the closed position. The switch actuator is configured with a button that is accessible by a user to facilitate manual manipulation of the switch actuator by a force applied to the button by the user. The printhead carrier is positioned based on an output of the switch.

In another form thereof, the present invention relates to a method for positioning a printhead carrier for an imaging apparatus. The method includes activating a printhead carrier drive system of the imaging apparatus to position the printhead carrier at a cartridge exchange opening when a cover of the imaging apparatus is detected to not be in a closed position; activating the printhead carrier drive system to position the printhead carrier at a printhead home position if the cover is not positioned in the closed position within a predetermined amount of time after being opened; and activating the printhead carrier drive system to reposition the printhead carrier at the cartridge exchange opening if, after the predetermined amount of time, the cover is open and a button is pressed by a user.

An advantage of the present invention is that it provides for convenient printhead cartridge replacement, even if the printhead cartridge has returned to a home position after the cover has been opened.

Another advantage of the present invention is that it reduces the chance of printer damage due to manual positioning of the printhead carrier by a user.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
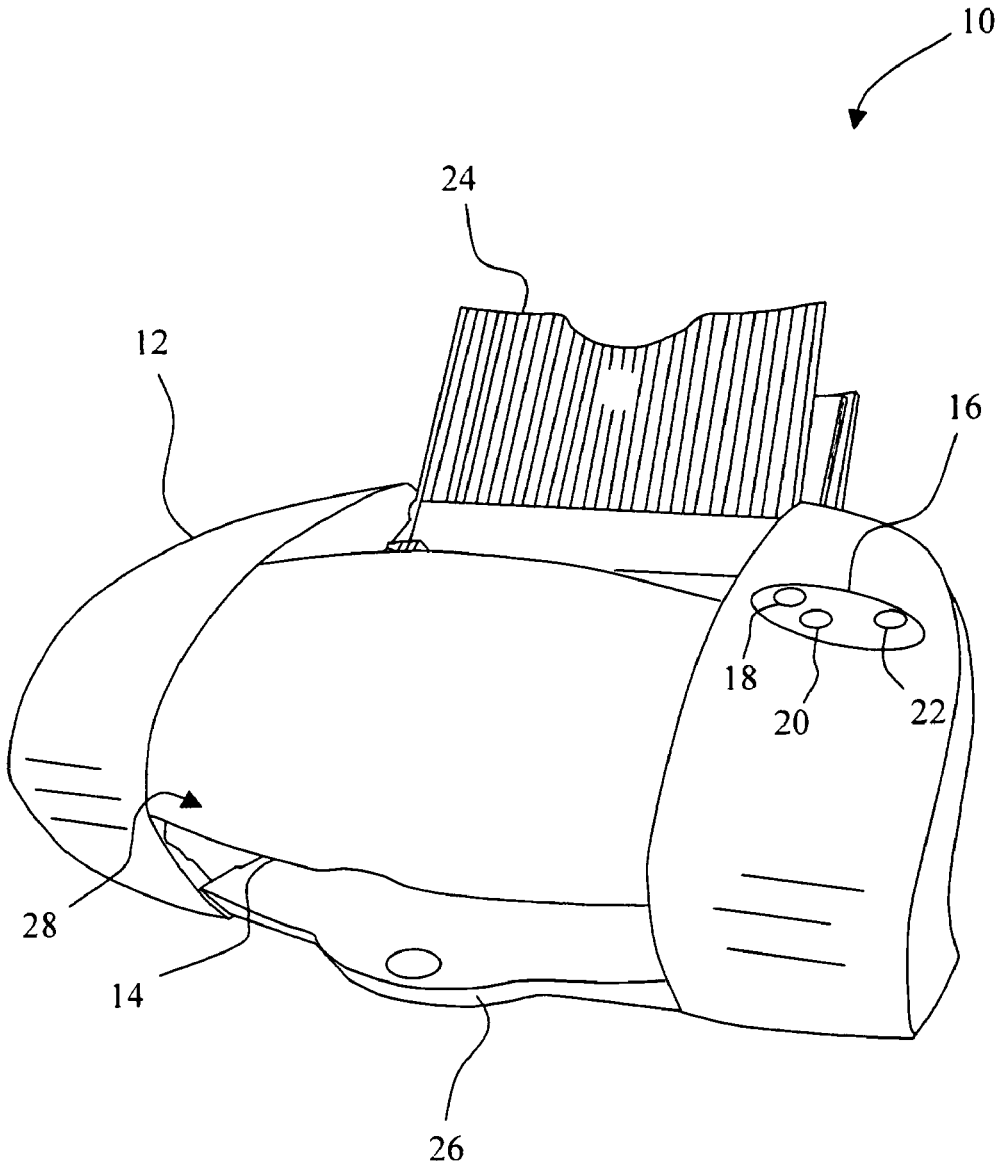
FIG. 1 is a perspective view of an imaging apparatus with a cover in a closed position.
Figure 2:
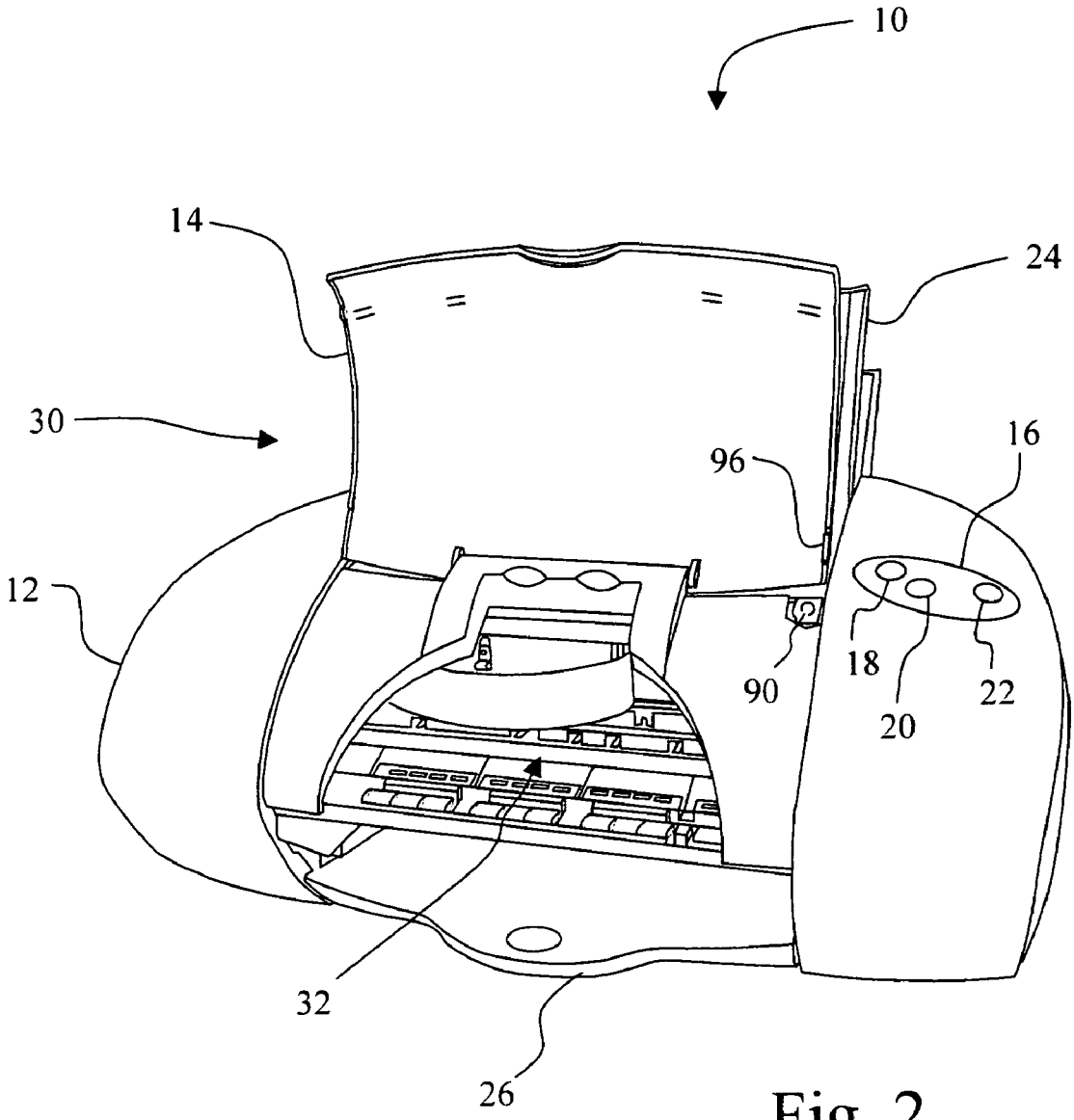
FIG. 2 is a perspective view of the imaging apparatus of FIG. 1 with the cover in an open position.

Referring now to the drawings, and particularly to FIGS. 1 and 2, there is shown an imaging apparatus 10. Imaging apparatus 10 may be, for example, a conventional ink jet printer, or a multi-function apparatus, such as for example, a standalone unit that has faxing and copying capability, in addition to printing. Accordingly, imaging apparatus 10 may be connected to a host, such as a computer (not shown).

Imaging apparatus 10 includes a housing 12, and a cover 14 mounted to housing 12. Also mounted to housing 12 is a user interface 16 having control buttons, such as for example, a duplex button 18, a line feed button 20 and a power ON button 22. Imaging apparatus 10 also includes a media source 24 and a media exit tray 26.

As shown in FIGS. 1 and 2, cover 14 is pivotably attached to housing 12 to facilitate an opening and closing of cover 14 with respect to housing 12 by a pivoting action. FIG. 1 shows cover 14 a closed position 28. FIG. 2 shows cover 14 in an open position 30. When cover 14 is in open position 30, there is exposed a cartridge exchange opening 32 formed in housing 12, and when cover 14 is in closed position 28, cartridge exchange opening 32 is not exposed.

Figure 3:
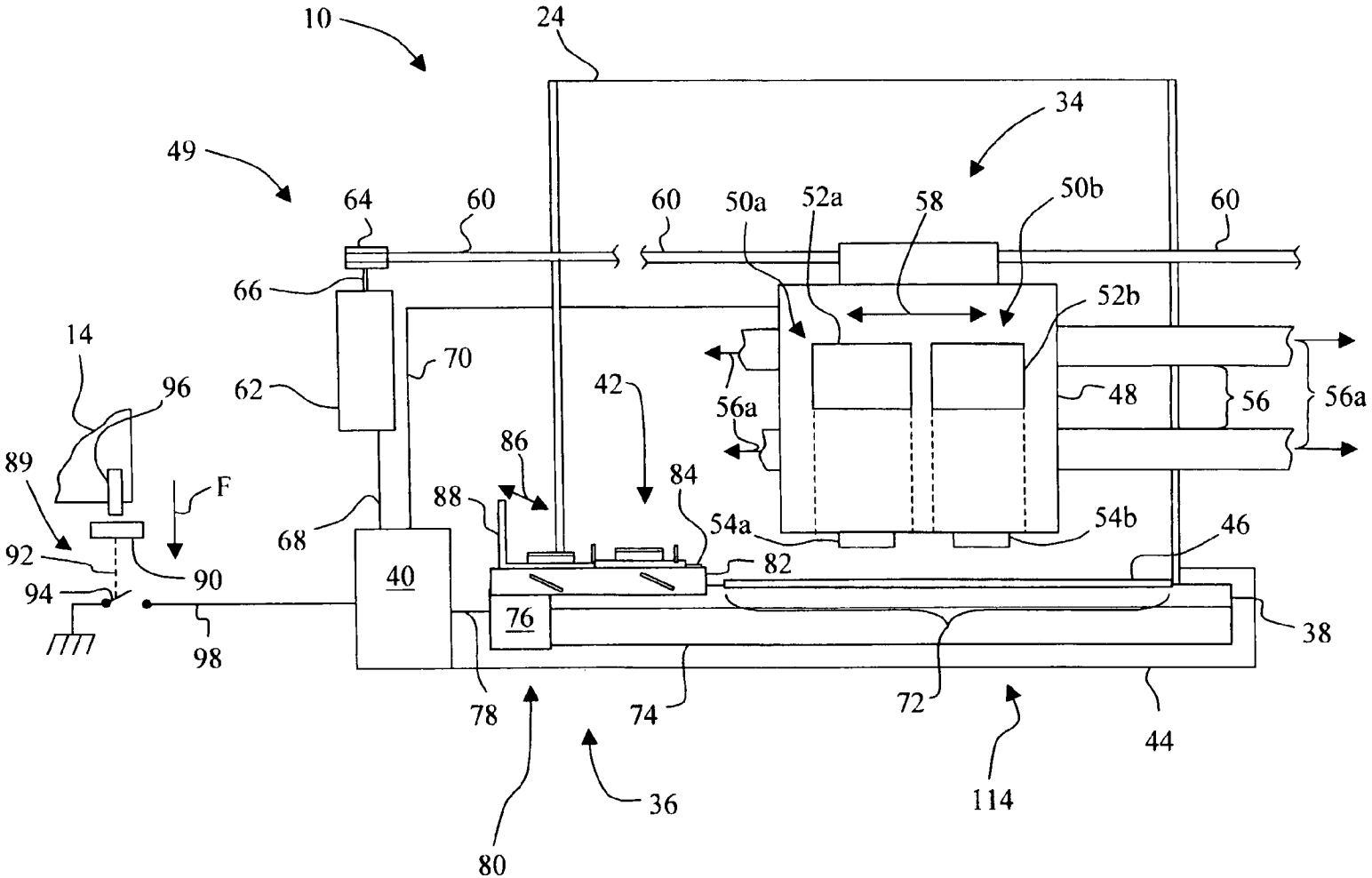
FIG. 3 is a diagrammatic representation of the imaging apparatus of FIGS. 1 and 2.

Referring to FIG. 3, imaging apparatus 10 further includes a printhead carrier system 34, a feed roller unit 36, a mid-frame 38, a controller 40 and a maintenance station 42, which are contained in housing 12. Printhead carrier system 34, feed roller unit 36, mid-frame 38, controller 40 and maintenance station 42 are coupled, e.g., mounted, to an imaging apparatus frame 44. Housing 12, as shown in FIGS. 1 and 2, may also be attached to imaging apparatus frame 44.

Media source 24 is configured and arranged to supply from a stack of print media a sheet of print media 46 to feed roller unit 36, which in turn further transports the sheet of print media 46 during a printing operation.

Printhead carrier system 34 includes a printhead carrier 48 and a printhead carrier drive system 49.

Printhead carrier 48 carries, for example, one, two, three or more printhead cartridges, such as a monochrome printhead cartridge 50*a* and/or a color printhead cartridge 50*b*, that is mounted thereto. Monochrome printhead cartridge 50*a* includes a monochrome ink reservoir 52*a* provided in fluid communication with a monochrome ink jet printhead 54*a* and formed as an integral unit. Color printhead cartridge 50*b* includes a color ink reservoir 52*b* provided in fluid communication with a color ink jet printhead 54*b* and formed as an integral unit. Alternatively, printhead cartridges 50*a*, 50*b* may only include ink reservoirs 52*a*, 52*b*, which in turn are coupled to respective remote ink jet printheads 54*a*, 54*b* via respective fluid conduits.

Printhead carrier 48 is guided by a pair of guide members 56. Either, or both, of guide members 56 may be, for example, a guide rod, or a guide tab formed integral with imaging apparatus frame 44. The axes 56*a* of guide members 56 define a bi-directional scanning path 58 of printhead carrier 48.

Printhead carrier 48 is connected to printhead carrier drive system 49, which includes a carrier transport belt 60 that is driven by a carrier motor 62 via a carrier pulley 64. In this manner, carrier motor 62 is drivably coupled to printhead carrier 48, although one skilled in the art will recognize that other drive arrangements could be substituted for the example given, such as for example, a worm gear drive. Carrier motor 62 can be, for example, a direct current motor or a stepper motor. Carrier motor 62 has a rotating motor shaft 66 that is attached to carrier pulley 64. Carrier motor 62 is coupled, e.g., electrically connected, to controller 40 via a communications link 68.

At a directive of controller 40, printhead carrier 48 is transported in a controlled manner along bi-directional scanning path 58, via the rotation of carrier pulley 64 imparted by carrier motor 62. During printing, controller 40 controls the movement of printhead carrier 48 so as to cause printhead carrier 48 to move in a controlled reciprocating manner, back and forth along guide members 56. In order to conduct printhead maintenance operations, controller 40 controls the movement of printhead carrier 48 to position printhead carrier in relation to maintenance station 42 and/or cartridge exchange opening 32.

Ink jet printheads 54*a*, 54*b* are electrically connected to controller 40 via a communications link 70. Controller 40 supplies electrical address and control signals to imaging apparatus 10, and in particular, to the ink jetting actuators of ink jet printheads 54*a*, 54*b*, to effect the selective ejection of ink from ink jet printheads 54*a*, 54*b*.

During a printing operation, the reciprocation of printhead carrier 48 transports ink jet printheads 54*a*, 54*b* across the sheet of print media 46 along bi-directional scanning path 58, i.e., a scanning direction, to define a print zone 72 of imaging apparatus 10. Bi-directional scanning path 58, also referred to as scanning direction 58, is parallel with axes 56*a* of guide members 56, and is also commonly known as the horizontal direction. During each scan of printhead carrier 48 when printing, the sheet of print media 46 is held stationary by feed roller unit 36. Feed roller unit 36 includes a feed roller 74 and a drive unit 76. The sheet of print media 46 is transported through print zone 72 by the rotation of feed roller 74 of feed roller unit 36. A rotation of feed roller 74 is effected by drive unit 76. Drive unit 76 is electrically connected to controller 40 via a communications link 78.

Maintenance station 42 is provided for performing printhead maintenance. operations on the ink jet nozzles of ink jet printheads 54*a*, 54*b*. Such operations may include, for example, a printhead spit maintenance operation, a printhead wiping operation and a printhead capping operation. The printhead capping operation occurs with printhead carrier 48 located in a home position 80, which is a far-left position along mid-frame 38 with respect to the components arranged as shown in FIG. 1. Other services, such as for example, printhead priming and suction, may also be performed if desired by the inclusion of a vacuum device (not shown) of the type well known in the art.

Maintenance station 42 includes, for example, a maintenance housing 82 and a movable maintenance sled 84. Maintenance housing 82 supports movable maintenance sled 84, which has mounted thereto respective printhead wipers and printhead caps. Maintenance sled 84 is configured for movement in the directions generally depicted by double-headed arrow 86 to predefined elevations, such as for example, a lowered printing elevation, an intermediate wiping elevation and a fully raised capping elevation. Maintenance sled 84 includes a carrier engagement member 88.

With the orientation of components as shown in FIG. 3, a leftward movement of printhead carrier 48 causes printhead carrier 48 to engage carrier engagement member 88, thereby causing maintenance sled 84 to move to the left and upward, as illustrated by arrow 86, progressing from a lowered, or rest, elevation to an intermediate, or wiping, elevation, and progressing from the wiping elevation to the full raised, or capping, elevation at home position 80. Maintenance sled 84 is biased to return to the lowered elevation when printhead carrier 48 is moved rightward toward print zone 72.

Referring to FIG. 3, imaging apparatus 10 includes a switch unit 89 having a cartridge exchange button 90 (see also FIG. 2), a switch actuator 92 and a switch 94. As shown in FIG. 1, when cover 14 is in closed position 28, cartridge exchange button 90 is not exposed, and, as shown in FIG. 2, when cover 14 is in open position 30, cartridge exchange button 90 is exposed and is accessible by a user for manual manipulation.

Cartridge exchange button 90 is used for both automatic and manual positioning of printhead carrier 48 at cartridge exchange opening 32 in accordance with the present invention. In the embodiment shown, cartridge exchange button 90 is mechanically linked to switch actuator 92, which in turn is communicatively linked to switch 94. Cover 14 includes an engagement surface 96, such as, for example, a protruding tab, positioned to engage cartridge exchange button 90 when cover 14 is moved to closed position 28 (FIG. 1).

Switch 94 may be, for example, an electrical micro-switch or an optical switch, the operation of each being well known in the art. Switch 94 is communicatively coupled to controller 40 via a communications link 98. Controller 40 monitors switch 94 for a change in switch status, i.e., a logic low-to-high transition or a logic high-to-low transition. For example, with cover 14 in closed position 28 depicted in FIG. 1, switch 94 may be held in a closed state by engagement of engagement surface 96 of cover 14 with cartridge exchange button 90. However, as cover 14 is moved from closed position 28 depicted in FIG. 1 toward the open position 30 depicted in FIG. 2, switch 94 may change to an open state by the disengagement of engagement surface 96 of cover 14 with cartridge exchange button 90, and controller 40 senses the low-to-high transition of this occurrence. Thereafter, when cartridge exchange button 90 is next depressed, either by engagement surface 96 when cover 14 is returned to the closed position 28 or by manual actuation by a user when cover 14 is open, controller 40 senses a high-to-low transition of switch 94. Then, when cartridge exchange button 90 is next released, controller 40 again senses a low-to-high transition of switch 94.

Those skilled in the art will recognize that whether controller 40 senses a low-to-high transition or a high-to-low transition upon the depressing of cartridge exchange button 90 will depend upon the type of switching mechanism that resides in switch 94, e.g., a normally closed switching mechanism or a normally open switching mechanism.

Figure 4:
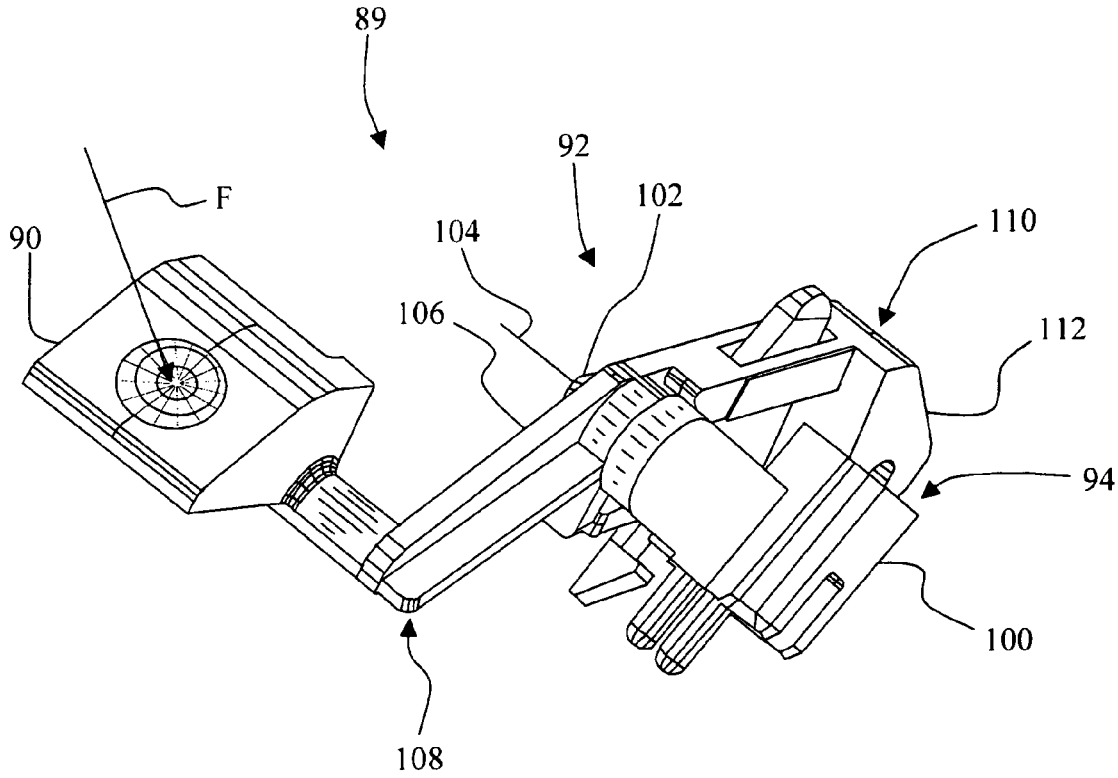
FIG. 4 is a perspective view of one embodiment of a switch unit of the imaging apparatus of FIGS. 1–3.

FIG. 4 shows an exemplary embodiment of a switch unit 89, wherein switch 94 is in the form of an optical switch, and switch actuator 92 is in the form of a mechanical flag. In this embodiment, switch actuator 92 is pivotably mounted to a switch housing 100 via a pivot pin 102 defining a pivot axis 104. Switch actuator 92 includes a lever 106 having a first end 108 spaced apart from a second end 110. Cartridge exchange button 90 is connected to first end 108 and a flag 112 is connected to second end 110.

Referring now to FIGS. 3 and 4, lever 106 is biased, such as for example, by gravity or by a spring, such that in the absence of a force F exerted on cartridge exchange button 90, then flag 112 is positioned to break the optical beam in switch 94, thereby placing switch 94 in an open condition. Switch 94 thus outputs a logic high signal via communication link 98 to controller 40. Upon application of force F to cartridge exchange button 90 in the direction indicated by the arrow, then lever 106 pivots about pivot axis 104 and flag 112 is raised, thereby allowing the optical beam to be received by a light detector in switch 94 and placing switch 94 in a closed condition. Switch 94 thus outputs a logic low signal via communication link 98 to controller 40.

In summary, referring to FIGS. 1 and 2, cartridge exchange opening 32 and cartridge exchange button 90 are concealed, i.e., not exposed, by cover 14 when cover 14 is in closed position 28, as in the case of normal printing. When cover 14 is opened, as shown in FIG. 2, engagement surface 96 of cover 14 disengages cartridge exchange button 90, and both cartridge exchange opening 32 and cartridge exchange button 90 are exposed.

Figure 5:
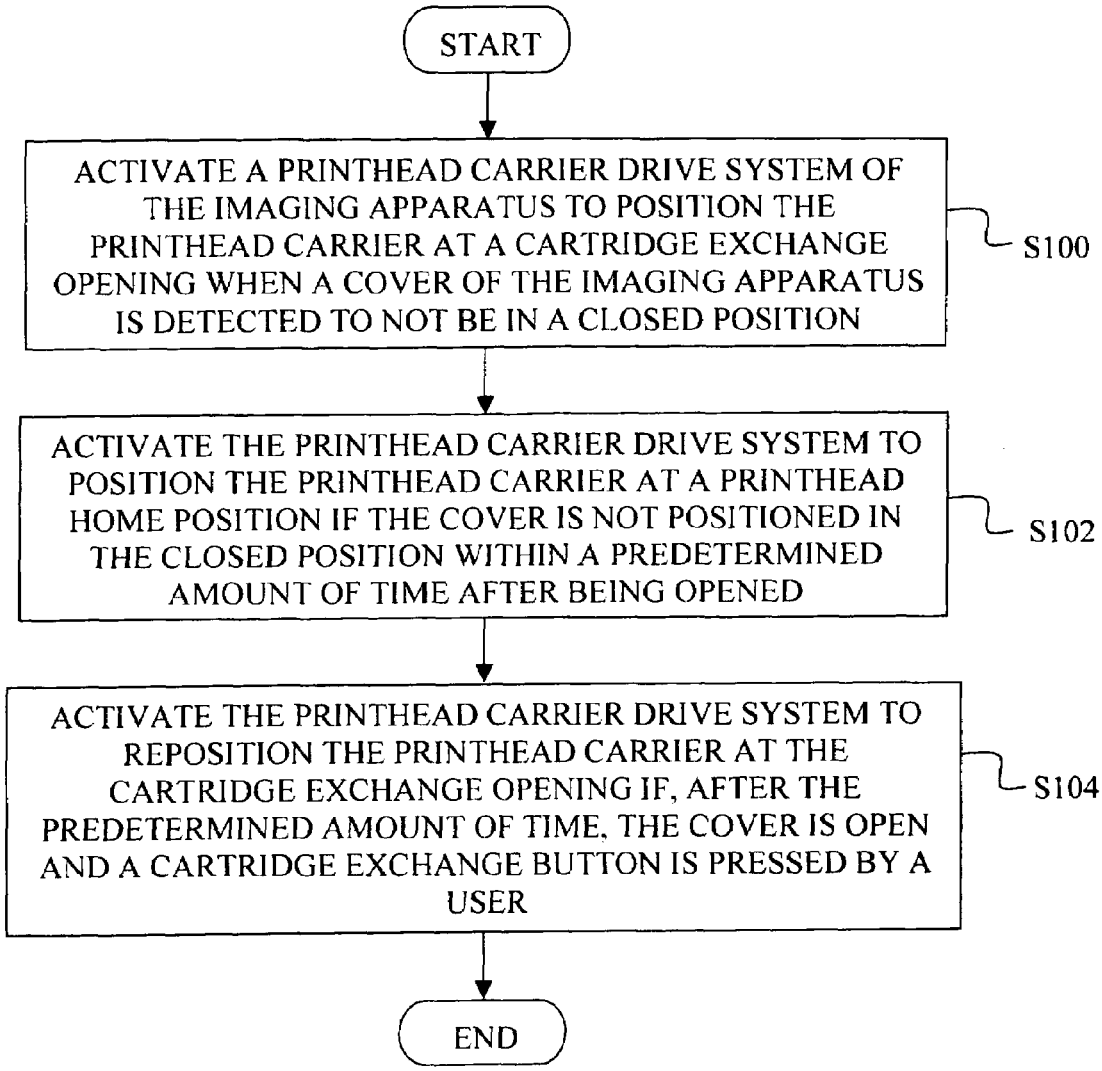
FIG. 5 is a general flowchart of a method for positioning a printhead carrier of the imaging apparatus of FIGS. 1–3, in accordance with the present invention.

FIG. 5 is a general flowchart of a method for positioning printhead carrier 48 for imaging apparatus 10, in accordance with the present invention.

At step S100, printhead carrier drive system 49 of imaging apparatus 10 is activated, via controller 40, to position printhead carrier 48 at a cartridge exchange position 114 (see FIG. 3) corresponding to cartridge exchange opening 32 (FIG. 2) when cover 14 of imaging apparatus 10 is detected to not be in closed position 28, e.g., is in open position 30. This detection occurs when engagement surface 96 of cover 14 disengages cartridge exchange button 90 of switch actuator 92.

At step S102, printhead carrier drive system 49 is activated, via controller 40, to position printhead carrier 48 at printhead home position 80 if cover 14 is not returned to closed position 28 within a predetermined amount of time after being opened, i.e., cover 14 remains open for too long. This predetermined amount of time may be, for example, in a range of 5 minutes to 50 minutes, or longer if desired, and serves to return printheads 54*a*, 54*b* to maintenance station 42 for capping to prevent liquid ink present in or on the nozzles of printheads 54*a*, 54*b* from drying and clogging.

At step S104, if, after the predetermined amount of time, cover 14 was not returned to closed position 28, and a user applies force F to cartridge exchange button 90, then printhead carrier drive system 49 is activated, via controller 40, to reposition printhead carrier 48 at cartridge exchange opening 32. Accordingly, even if printhead carrier 48 is no longer readily accessible by the time the user is ready to replace one or more of printhead cartridges 54*a*, 54*b* after cover 14 was originally opened, by pushing cartridge exchange button 90, the user may manually reposition printhead carrier 48 at cartridge exchange opening 32 in a manner that is not damaging to printhead carrier system 34.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a housing having a cartridge exchange opening;

a printhead carrier system contained in said housing, said printhead carrier system having a printhead carrier;

a cover pivotably attached to said housing, said cover having an engagement surface, wherein when said cover is in a closed position said cartridge exchange opening is not exposed; and a switch unit having a switch actuator and a switch, said switch having an output selectable between a plurality of states, said switch actuator being configured for actuating said switch, said engagement surface of said cover being positioned to engage said switch actuator to select one of said plurality of states of said switch when said cover is in said closed position, and said switch actuator being linked with a button that is accessible by a user to facilitate manual manipulation of said switch actuator by a force applied to said button by said user to manually select one of said plurality of states of said switch, said printhead carrier being positioned based on said output of said switch.

2. The imaging apparatus of claim 1, wherein said button is not exposed when said cover is in said closed position and said button is exposed when said cover in an open position.

3. The imaging apparatus of claim 1, further comprising a controller communicatively coupled to said switch and communicatively coupled to said printhead carrier system, said controller being configured to perform the acts of:

activating a printhead carrier drive system of said imaging apparatus to position said printhead carrier at said cartridge exchange opening when said cover of said imaging apparatus is detected to not be in said closed position;

activating said printhead carrier drive system to position said printhead carrier at a printhead home position if said cover is not positioned in said closed position within a predetermined amount of time after being opened; and activating said printhead carrier drive system to reposition said printhead carrier at said cartridge exchange opening if, after said predetermined amount of time, said cover is open and said button is pressed.

4. The imaging apparatus of claim 3, wherein said printhead home position is a printhead capping position.

5. The imaging apparatus of claim 3, wherein said predetermined amount of time is in a range of 5 minutes to 50 minutes.

6. The imaging apparatus of claim 1, wherein said button is integral with said switch actuator.

7. The imaging apparatus of claim 1, said switch being one of an electrical switch and an optical switch.

8. A method for positioning a printhead carrier for an imaging apparatus, comprising:

activating a printhead carrier drive system of said imaging apparatus to position said printhead carrier at a cartridge exchange opening when a cover of said imaging apparatus is detected to not be in a closed position;

activating said printhead carrier drive system to position said printhead carrier at a printhead home position if said cover is not positioned in said closed position within a predetermined amount of time after being opened; and activating said printhead carrier drive system to reposition said printhead carrier at said cartridge exchange opening if, after said predetermined amount of time, said cover is open and a button is pressed by a user.

9. The method of claim 8, wherein said printhead home position is a printhead capping position.

10. The method of claim 8, wherein said predetermined amount of time is in a range of 5 minutes to 50 minutes.

11. The method of claim 8, wherein said button is integral with a switch actuator that detects that said cover is open.

12. The method of claim 11, wherein said button is positioned under said cover such that said button is not exposed unless said cover is open.

* * * * *